US008662863B2

(12) United States Patent
Speir

(10) Patent No.: US 8,662,863 B2
(45) Date of Patent: Mar. 4, 2014

(54) SYSTEM AND METHOD FOR MODIFYING AN AUTOMOBILE ENGINE FOR USE AS A GAS COMPRESSOR

(75) Inventor: Thompson Speir, Okemah, OK (US)

(73) Assignee: OTA Compression, LLC, Irving, TX (US)

( * ) Notice: Subject to any disclaimer, the term of this patent is extended or adjusted under 35 U.S.C. 154(b) by 491 days.

(21) Appl. No.: 12/981,346

(22) Filed: Dec. 29, 2010

(65) Prior Publication Data

US 2011/0158825 A1 Jun. 30, 2011

Related U.S. Application Data

(60) Provisional application No. 61/290,742, filed on Dec. 29, 2009.

(51) Int. Cl.
*F04B 41/00* (2006.01)
*F04B 17/00* (2006.01)
*F04B 39/10* (2006.01)

(52) U.S. Cl.
USPC ..... 417/236; 417/364; 417/569

(58) Field of Classification Search
USPC ..... 417/569, 236, 364; 92/78
See application file for complete search history.

(56) References Cited

U.S. PATENT DOCUMENTS

| | | | | | |
|---|---|---|---|---|---|
| 1,494,741 | A | * | 5/1924 | Hale | 417/258 |
| 1,804,873 | A | | 5/1931 | Hoffman | |
| 1,992,400 | A | * | 2/1935 | Smith | 417/237 |
| 2,030,759 | A | * | 2/1936 | Neal | 417/521 |
| 2,312,335 | A | * | 3/1943 | Halleck | 417/243 |
| 2,500,366 | A | | 3/1950 | Lamberton | |
| 2,628,015 | A | * | 2/1953 | Neugebauer et al. | 417/203 |
| 3,561,416 | A | * | 2/1971 | Kiekhaefer | 123/193.3 |
| 3,945,367 | A | * | 3/1976 | Turner, Jr. | 123/198 F |
| 4,255,090 | A | | 3/1981 | Pratt | |
| 4,350,475 | A | * | 9/1982 | Meece et al. | 417/238 |
| 4,372,257 | A | | 2/1983 | Hofbauer et al. | |
| 4,563,132 | A | * | 1/1986 | Grimmer | 417/247 |
| 4,700,663 | A | * | 10/1987 | Dunn | 123/1 R |
| 4,708,107 | A | * | 11/1987 | Stinebaugh | 123/317 |
| 4,887,514 | A | * | 12/1989 | Schintgen | 92/79 |
| 4,961,691 | A | * | 10/1990 | Waldrop | 417/237 |
| 5,033,940 | A | * | 7/1991 | Baumann | 417/273 |
| 5,195,874 | A | * | 3/1993 | Odagiri | 417/27 |
| 5,203,680 | A | * | 4/1993 | Waldrop | 417/364 |
| 5,267,843 | A | | 12/1993 | Waldrop | |

(Continued)

OTHER PUBLICATIONS

OTA Compression, LLC, "Daily usage chart showing test results obtained during an experimental usage period", non-published, 3 pages.

(Continued)

*Primary Examiner* — Charles Freay
*Assistant Examiner* — Alexander Comley

(57) ABSTRACT

In accordance with various embodiments of the present invention, a system and method are provided for converting a conventional automobile engine into a gas compressor. In various embodiments, the system and method may provide an economical and efficient gas compressor by modification of a balance-opposed internal-combustion engine to provide a balance-opposed gas compressor. More specifically, in some embodiments, the modification may include a uniquely designed cylinder head adapted to convert an automobile engine into a gas compressor for the recovery, gathering, transfer, or staged compression of natural gas. In one embodiment, a four-cylinder balance-opposed engine is utilized.

14 Claims, 7 Drawing Sheets

(56) References Cited

U.S. PATENT DOCUMENTS

| | | | | | |
|---|---|---|---|---|---|
| 5,314,314 | A | * | 5/1994 | Hinkle | 417/364 |
| 5,378,113 | A | * | 1/1995 | Caldwell | 417/236 |
| 5,485,674 | A | | 1/1996 | Caldwell | |
| 5,575,628 | A | * | 11/1996 | Caldwell | 417/364 |
| 5,785,505 | A | * | 7/1998 | Price | 417/364 |
| 5,947,697 | A | * | 9/1999 | Morrison | 417/237 |
| 6,053,713 | A | * | 4/2000 | Brown | 417/571 |
| 6,074,177 | A | * | 6/2000 | Kobayashi et al. | 417/313 |
| 6,176,690 | B1 | | 1/2001 | Knepp | |
| 6,328,012 | B1 | | 12/2001 | Clements | |
| 6,695,591 | B2 | * | 2/2004 | Grimmer et al. | 417/203 |
| 6,776,587 | B2 | * | 8/2004 | Meyer et al. | 417/248 |
| 2004/0018098 | A1 | * | 1/2004 | Beckman et al. | 417/234 |
| 2006/0222520 | A1 | * | 10/2006 | Goodell | 417/313 |

OTHER PUBLICATIONS

Dunn-Right Incorporated, "When it has to be Dunn-Right", www.dunnrightinc.com, printed Nov. 2010, 4 pages.

Corken, "Industrial Horizontal Compressors", IDEX Corporation, Jan. 1999, 11 pages.

* cited by examiner

SYSTEM AND METHOD FOR MODIFYING AN AUTOMOBILE ENGINE FOR USE AS A GAS COMPRESSOR

CROSS REFERENCE TO RELATED APPLICATIONS

This application claims benefit under 35 U.S.C. §119(e) to U.S. Provisional Patent Application Ser. No. 61/290,742, filed Dec. 29, 2009, the entire contents of which are hereby incorporated by reference as if fully disclosed herein.

BACKGROUND

1. Technical Field

This invention relates in general to the field of compressors, and more particularly, but not by way of limitation, to systems and methods for utilizing and/or modifying portions of a conventional automobile engine for use as a gas compressor.

2. Background

Gas compressors are used in various applications where either higher pressures or lower volumes of gas are needed, such as, for example, in petroleum refineries, natural gas processing plants, petrochemical and chemical plants, and similar large industrial plants for compressing intermediate and end product gases, and in pipeline transport of purified natural gas from the production site to the consumer. Often, compressors in these environments are driven by a gas turbine which may be fueled by a gas bled from the pipeline, thus, no external power source is necessary.

Pumps for liquid pipelines and compressors for gas pipelines are often located at compressor stations along the pipeline to facilitate the transportation of product through the pipelines. The location of these stations may be defined by the topography of the terrain, the type of product being transported, and/or operational conditions of the network. For example, natural gas, while being transported through a gas pipeline, needs to be constantly pressurized, requiring compressor stations to be located in certain distance intervals along the pipe ranging anywhere from 40 to 100 miles or more. Oftentimes, specially customized turbines, motors, and/or engines are required in each of these compressor stations, which may be in remote locations.

One type of compressor often used along a gas pipeline is a reciprocating compressor. A reciprocating compressor or piston compressor is a positive-displacement compressor that uses pistons driven by a crankshaft to deliver gases at high pressure. The intake gas enters a suction manifold, then flows into the compression cylinder where it is compressed by a piston driven in a reciprocating motion via a crankshaft before being discharged back into the pipeline. Reciprocating compressors can be either stationary or portable, can be single or multi-staged, and can be driven by electric motors or internal combustion engines. Small reciprocating compressors from 5 to 30 horsepower (hp) are commonly seen in automotive applications and are typically limited to intermittent duty. Larger reciprocating compressors, well over 1,000 hp (750 kW) and capable of very high discharge pressures (e.g., >6000 psi or 41.4 MPa), are commonly found in large industrial and petroleum applications.

In the past, these types of large industrial compressors have been utilized for the compression of gas for use in recovery, gathering, transfer, and/or storage of natural gas. There are various potential benefits to using these large industrial compressors including accessibility to the interior areas of the compressor for maintenance purposes such as, for example, removable access panels and/or easily removable major components. Oftentimes, maintenance access options are not available in smaller compressors. However, these large industrial compressors are not practical for field use for various reasons, including, for example, cost, weight, size, and hp requirements.

Various prior art devices currently in use for gas compression include modified devices from other industries. In some devices, industrial compressors, such as industrial horizontal compressors, are converted for use in natural gas compression. One drawback to the use of this type of compressor for natural gas compression is that it requires a specialized manufacturer to manufacture modified parts for conversion to a natural gas compressor. In addition, the extensive modifications also require specially manufactured components for use, maintenance, and repairs, which greatly increases the operating cost of such devices.

In other prior art devices, compressors have been formed utilizing modified automotive engines to provide both power to the device and compression. However, utilization of such mono-block designs to compress natural gas may be considered to involve some operational risks because of the proximity of the cylinders having combustion therein and the cylinders having a flammable material such as natural gas flowing therethrough. One prior art device, as disclosed in U.S. Pat. No. 5,267,843, which is hereby incorporated by reference, attempts to overcome this danger with a complicated venting systems to vent any gas that might build up in the compressor.

Many of the prior art devices for utilizing an internal combustion engine as a compressor contemplate converting an automobile engine having a V-shaped configuration, such as for example, a V-8 engine, into a compressor. However, there are various deficiencies inherent to the V-shaped orientation of the cylinders of, for example, a V-8 engine relative to use as a compressor. One prior art device, as disclosed in U.S. Pat. No. 4,700,663, which is hereby incorporated by reference, attempts to overcome some of these deficiencies by utilizing a modified horizontally opposed engine, such as the Type-1 VOLKSWAGEN internal combustion engine, to form an air compressor.

SUMMARY OF THE INVENTION

In accordance with the present invention, a system and method are provided for utilizing and/or modifying a conventional automobile engine into a gas compressor. In various embodiments, the system and method may provide an economical and efficient gas compressor by modification of a balance-opposed internal-combustion engine to provide a balance-opposed gas compressor. For example, in one embodiment, the balance-opposed engine may be a VOLKSWAGEN engine, such as a Type 1, 1600 cc, four cylinder engine. More specifically, in some embodiments, the modification may include a uniquely designed cylinder head adapted to convert an automobile engine into a gas compressor for the recovery, gathering, transfer, or staged compression of natural gas.

The above summary of the invention is not intended to represent each embodiment or every aspect of the present invention. Particular embodiments may include one, some, or none of the listed advantages.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

Figure 1A:
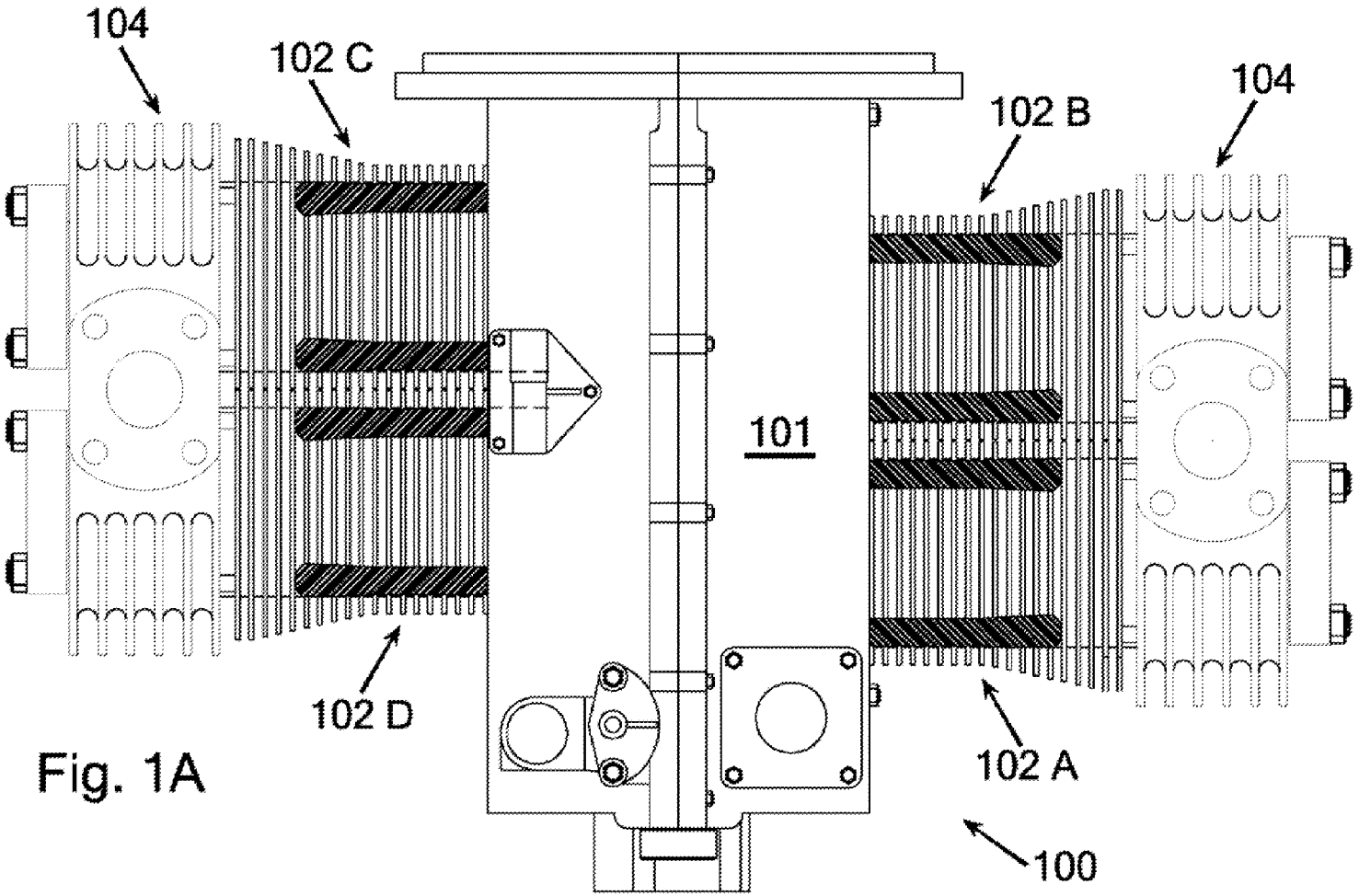
FIGS. 1A-1C are various views of a gas compressor formed from a balance-opposed automobile engine.
Figure 1B:
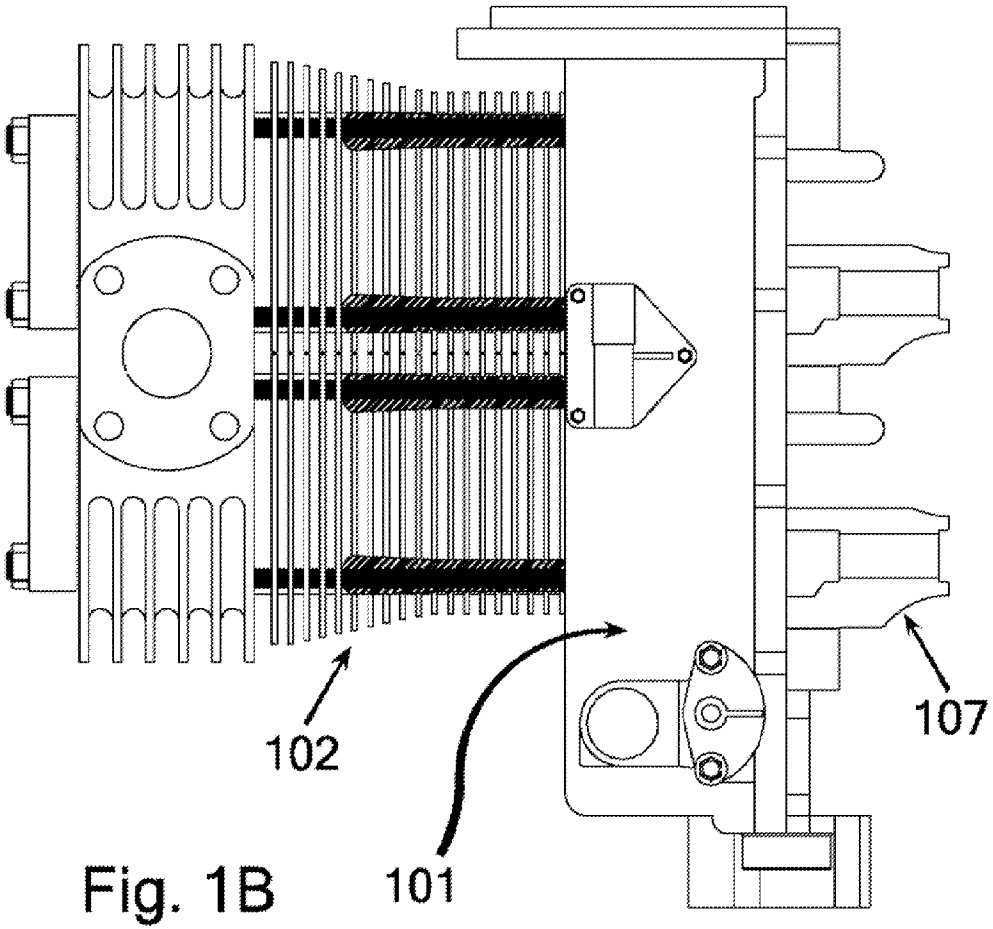
Figure 1C:
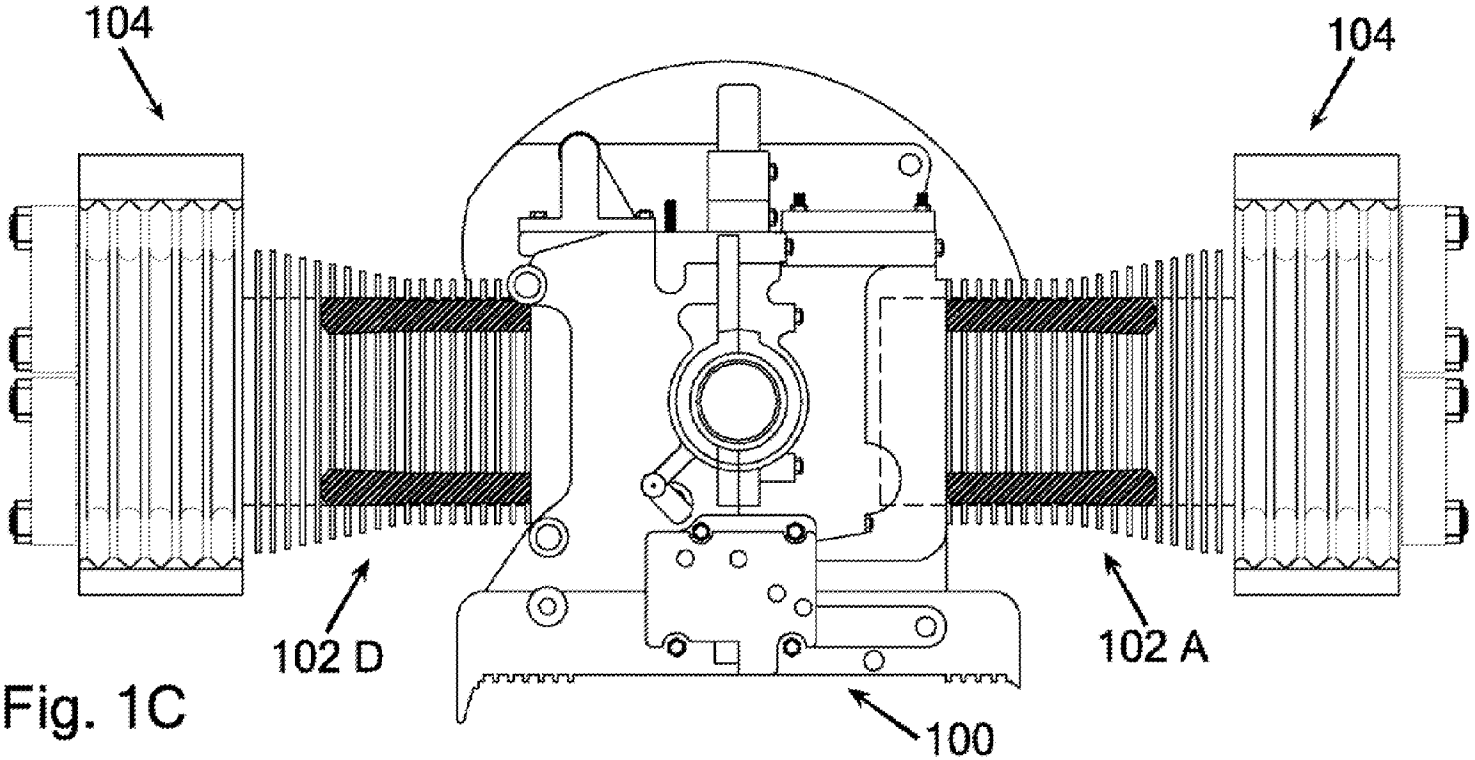

Referring now to FIGS. 1A-1C collectively, various views of an embodiment of a gas compressor 100 are shown in accordance with the present invention. In the embodiment shown, the gas compressor 100 has been formed from a four-cylinder balance-opposed internal-combustion engine having pistons that reciprocate in cylinders disposed in a horizontal plane. A flat engine, or horizontally-opposed engine, is an internal combustion engine with multiple pistons that all move in the horizontal plane. A four-cylinder horizontally opposed is a flat engine with four cylinders arranged horizontally in two banks of two cylinders on each side of a central crankcase. As will be explained in more detail below, the automobile engine from which the gas compressor 100 has been formed has four cylinders 102A-102D, where a first bank of two cylinders 102A and 102B is disposed on one side of the gas compressor 100 and a second bank of two cylinders 102C and 102D is disposed on an opposite side of the gas compressor 100 with a crankshaft 107 (shown in FIG. 1B) disposed therebetween. The pistons are usually mounted on the crankshaft such that opposing pistons move back and forth in opposite directions at the same time. The configuration results in inherently good balance of the reciprocating parts.

It should be noted that the crankshaft may be coupled and or adapted to be coupled to an external power source in a number of ways. For example, one method of coupling a compressor to an external power source, such as an internal combustion engine, is disclosed in U.S. Pat. No. 6,176,690, which is hereby incorporated by reference.

Still referring to FIGS. 1A-1C collectively, in various embodiments, the gas compressor 100 may utilize a modified head assembly 104 in conjunction with various unmodified components from the original automobile engine for ease of maintenance and parts replacement. As can be seen, the original engine block 101 may be maintained with the modified head assembly 104 mounted peripheral to the cylinders 102 allowing ease of conversion from an internal combustion engine to a gas compressor. During maintenance, this configuration allows ease of disassembly and access to all major components of the gas compressor 100 for inspection, maintenance, and repair. While modification of an automobile engine via, among other things, replacing a head thereof may be economical in limited production, in large production, it may be economical to utilize an engine block or portions thereof designed for use as a gas compressor.

Still referring to FIGS. 1A-1C collectively, the gas compressor 100 may be adapted to utilize all four of the cylinders 102A-102D of the automobile engine for compression. In prior art embodiments, one or more cylinders of an internal combustion engine were used to power the gas compressor, leaving less than all of the cylinders available for gas compression. To increase the volume of gas capable of being compressed, the gas compressor 100 utilizes an external power source to rotate the crankshaft rather than using any of the cylinders to provide power. In the embodiment shown, the gas compressor 100 may include two modified head assemblies 104, wherein each of the first bank of cylinders (102A and 102B) and second bank of cylinders (102C and 102D) are coupled to a common modified head assembly 104. While various embodiments may utilize some of the cylinders for gas compression and some to power the gas compressor 100, utilizing a separate power source may be beneficial in some embodiments to increase the volume of gas capable of being compressed and/or to keep the natural gas being compressed separate from sparks or other flames of a typical internal combustion engine.

Figure 2:
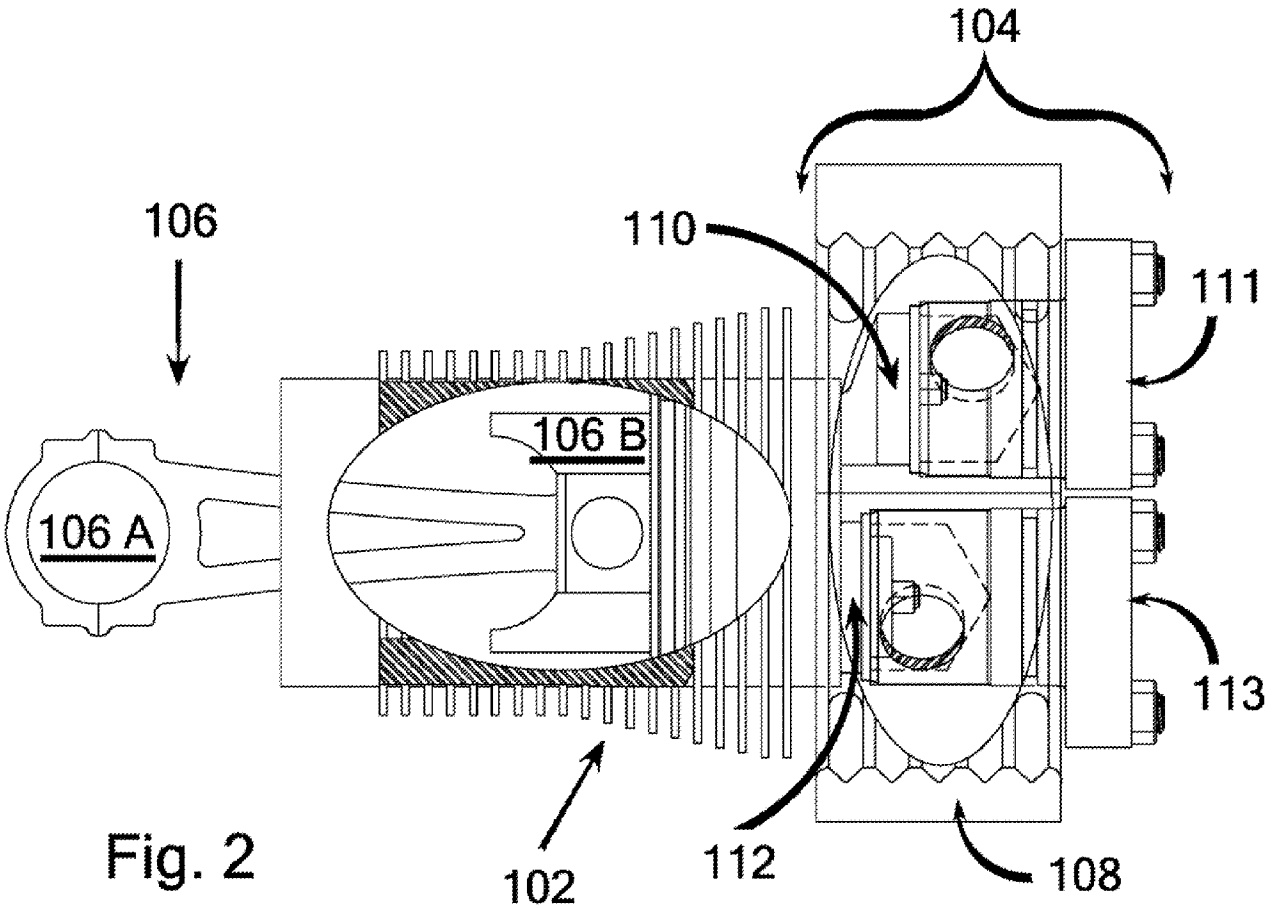
FIG. 2 is a cut-away side view of a cylinder assembly of the gas compressor of FIGS. 1A and 1B.

Referring now to FIG. 2, a side view of one cylinder 102 of the gas compressor 100 of FIGS. 1A and 1B is shown having a modified head assembly 104 mounted thereto. In the embodiment shown, the cylinder 102 includes a piston 106 reciprocally disposed therein, the piston 106 having a first end 106A adapted to be connected to the crankshaft and a piston head disposed at a second end 106B thereof. As explained in more detail below, in various embodiments, the modified head assembly 104 may include a head 108 having an inlet port disposed on a top surface thereof and an outlet port disposed on a bottom surface thereof. The modified head assembly 104 may also include a suction valve 110 disposed therein, which is secured in place by a suction valve chair 111 and a discharge valve 112, which is secured in place by a discharge valve chair 113. The suction valve chair 111 and the discharge valve chair 113 may be mounted to the head 108 via mounting studs and nuts 114.

Still referring to FIG. 2, as known to those skilled in the art of internal combustion engines, the rotation of the crankshaft 107 (shown in FIG. 1B) produces a reciprocating motion to the connecting rods of the piston 106. When the piston 106 travels away from the head 108, a vacuum is formed inside of the cylinder 102. This vacuum effect sucks gas through an opening in the suction valve chair 111 which is mounted at the top of the head 108 and past the suction valve 110 and into the cylinder 102. The suction valve 110 may be, for example, a one-way spring-actuated disc valve. Upon the return travel of the piston 106 towards the modified assembly head 104, the gas is compressed and forced out of the cylinder 102 through the discharge valve 112 and through an opening in the discharge valve chair 113. Upon the clearance of the opening in the discharge valve chair 113, the gas continues its exhaust path out of the modified head assembly 104 via the outlet port.

Figure 3A:
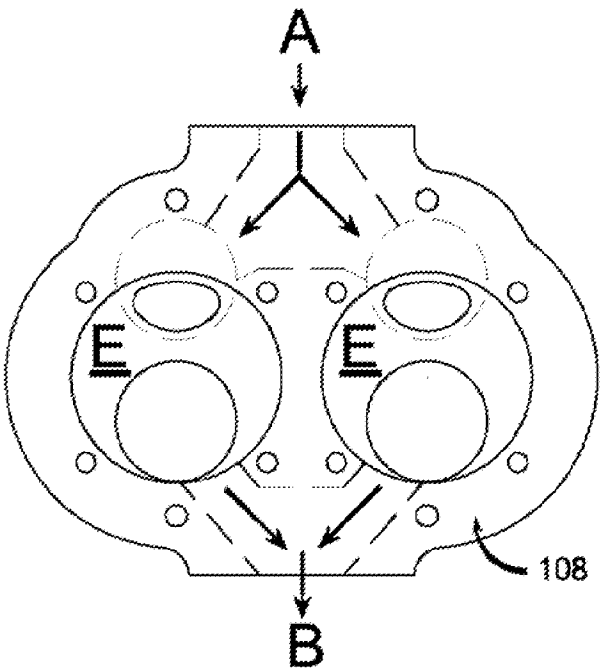
FIGS. 3A-3C are various views of a cylinder head of the cylinder assembly of FIG. 2.
Figure 3B:
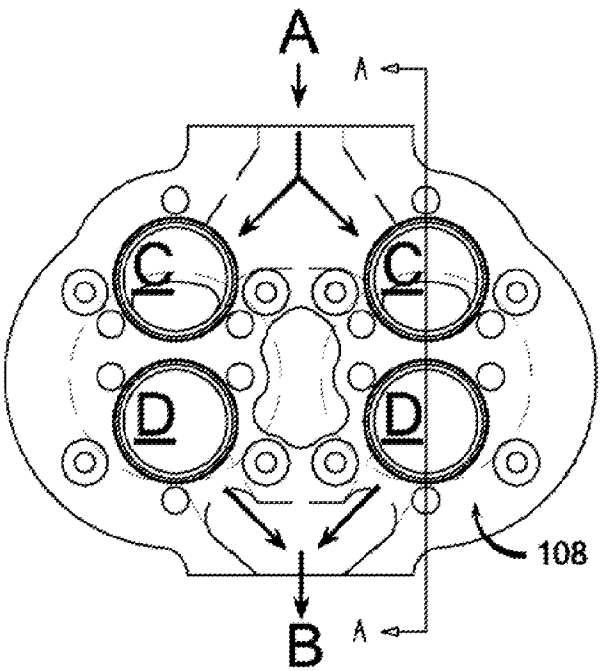
Figure 3C:
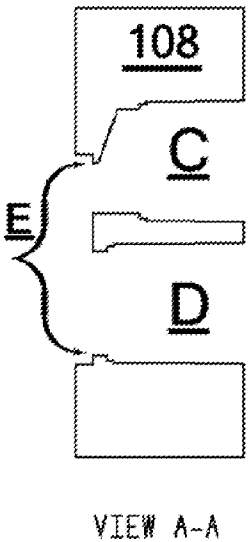

Referring now to FIGS. 3A-3C, various views of head 108 of FIG. 2 are shown. Referring specifically to FIG. 3A, a view of an inside surface of the head 108 can be seen. When mounted to the engine block 101, the inside surface of the head 108 is adapted to abut the cylinders 102 and the two piston receiving bores (marked as "E") are adapted to align with the piston 106 disposed therein. Referring now specifically to FIG. 3B, a view of an outside surface of the head 108 can be seen. Suction valve receiving bores (marked as "C") and discharge valve receiving bores (marked as "D") can be seen disposed on an outside surface of the head 108. Referring now to FIG. 3C, a side view along line A-A of FIG. 3B is shown. As can be seen from this view and as will be described in more detail below, a flowpath can be seen from suction valve receiving bore C through piston receiving bore E to discharge valve receiving bore D. In various embodiments, the head 108 has been designed to be able to handle more than 500 psi as compared to various other prior art devices that typically can only handle up to 120 psi. In some embodiments, two modified head assemblies 104 may be utilized in conjunction with a four-cylinder engine, where the discharge port B of one modified head assembly 104 is coupled to the suction port A of the other modified head assembly 104. In that way, additional compression may be provided via the two stages of compression.

Figure 4B:
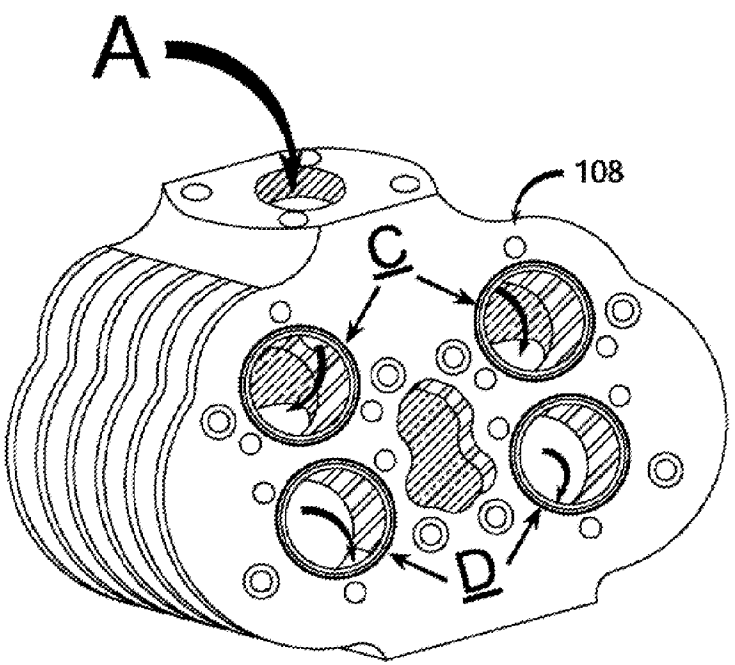
FIGS. 4A and 4B are front and back perspective views of the cylinder head of the cylinder assembly of FIG. 2.
Figure 4A:
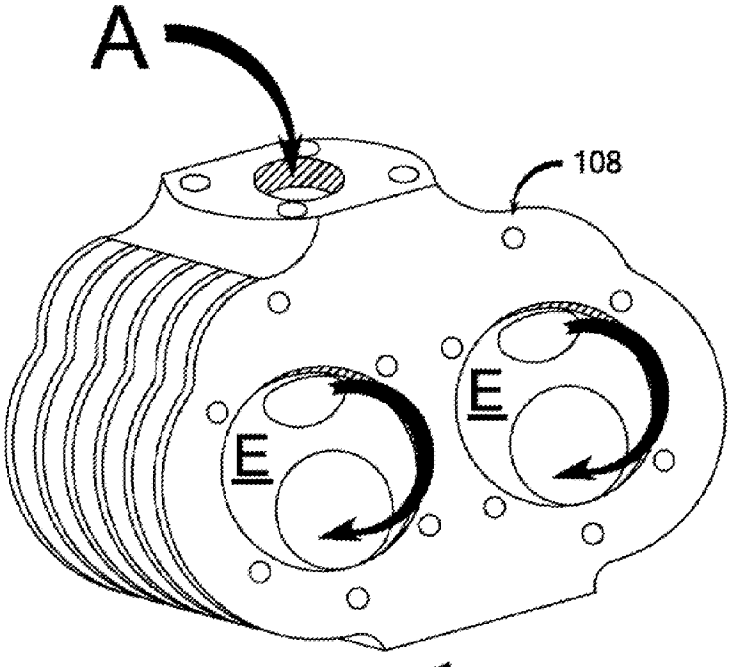

Referring now to FIGS. 4A-4B, various views of head 108 of FIG. 2 are shown. As can be seen from these view in combination, when the piston (not shown) retreats from the head 108, gas from, for example, a gas supply line enters the head 108 via a single suction port (marked as "A") disposed on a top surface thereof. The gas then flows from the suction port and into the two suction valve receiving bores C. From there, the gas then passes through each suction valve 110 (shown in FIG. 2) and into the corresponding cylinder 102 (not shown). When the piston advances towards the head 108, the gas is compressed and the compressed gas flows out of the cylinder 102 through the corresponding discharge valves (not shown) and into the discharge valve receiving bores D. The gas then flows from the discharge valve receiving bores D and out the single discharge port (marked "B") disposed on a bottom surface of the head 108. In various embodiments, the discharge valves location is such that it enables the cylinder to discharge condensation during run time and eliminates buildup of condensate in the cylinders during down time. This is achieved by the natural gas exiting the cylinders at a lower level than the cylinder creating a venturi effect on any fluid contained therein, thus any condensate is carried out with the gas.

Figure 5B:
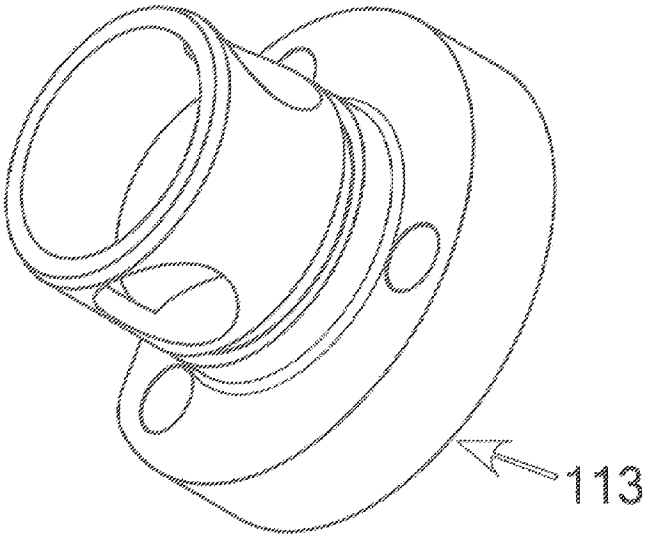
FIGS. 5A and 5B are perspective views of a suction and a discharge valve of the cylinder assembly of FIG. 2.
Figure 5A:
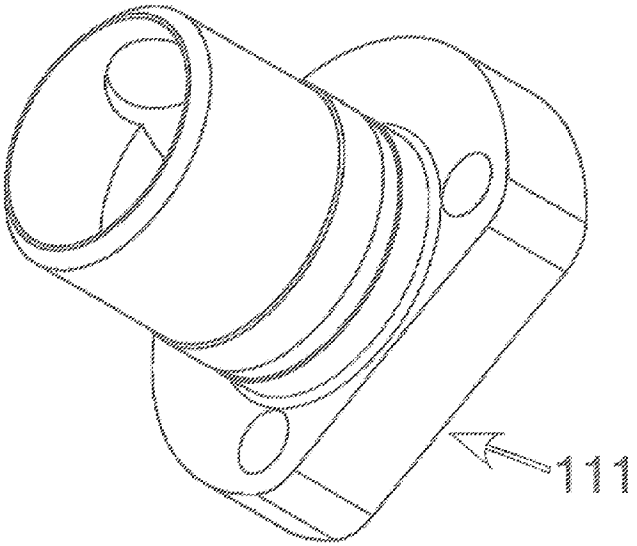

Referring now to FIGS. 5A and 5B, perspective views of a suction chair 111 and a discharge chair 113 are shown. The chairs 111 and 113 may be disposed in the head 108 to secure the suction and discharge valves disposed therein.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A gas compressor system adapted for operation by an external power source, the compressor system comprising:

a horizontally opposed engine block of an internal combustion engine having a plurality of cylinders disposed therein, wherein a first bank of at least two cylinders of the plurality of cylinders is disposed on a first side of the engine block, the at least two cylinders being disposed in a side-by-side relationship;

a crankshaft rotatably disposed in the engine block and exposed therefrom for powered rotation by an external power source;

a piston reciprocally disposed in each of the plurality of cylinders and connected to the crankshaft for reciprocal motion therein in response to the rotation of the crankshaft by the external power source; and a modified head assembly mounted to the engine block, the modified head assembly adapted to afford controlled flow of gas therethrough for the compression thereof and comprising:

a suction port on a first surface of the modified head assembly for receipt of gas to be compressed;

a discharge port on a second surface of the modified head assembly for discharge of compressed gas;

at least two suction valve receiving bores, each suction valve receiving bore having a suction valve disposed therein, each suction valve being a one-way valve oriented to facilitate gas flow from the suction port to one of the cylinders of the plurality of cylinders; and at least two discharge valve receiving bores, each discharge valve receiving bore having a discharge valve disposed therein, each discharge valve being a one-way valve oriented to facilitate gas flow from one of the cylinders of the plurality of cylinders to the discharge port, and each of the discharge valves comprises a position at a lower level than at least one of the cylinders.

2. The gas compressor system of claim 1, further comprising:

a second bank of at least two cylinders of the plurality of cylinders disposed on a second side of the engine block, the at least two cylinders being disposed in a side-by-side relationship; and a second modified head assembly mounted to the second side of the engine block.

3. The gas compressor system of claim 1, wherein the modified head assembly mounted to the engine block is capable of handling on the order of 500 psi of natural gas disposed therein.

4. The gas compressor system of claim 1, wherein the second surface of the modified head assembly is a bottom surface thereof.

5. The gas compressor system of claim 1, wherein the pistons reciprocate in a horizontal plane and the discharge valves are disposed near a lower portion of the cylinders to facilitate drainage of moisture therefrom.

6. The gas compressor system of claim 1, wherein the flow of gas through the modified head assembly creates a venturi effect therein to facilitate moisture removal therefrom.

7. A method of compressing a gas comprising:

providing a horizontally opposed engine block having a plurality of cylinders disposed therein, a first bank of cylinders of the plurality of cylinders being disposed in a side-by-side relationship, each cylinder having a piston reciprocally disposed therein;

providing a crankshaft rotatably disposed in the engine block and coupled to each piston;

mounting a modified head assembly to the engine block, the modified head assembly comprising:

a single suction port on a first surface thereof, a single discharge port on a second surface thereof, at least two suction valve receiving bores, each suction valve receiving bore having a suction valve disposed therein, each suction valve being a one-way valve oriented to facilitate gas flow from the suction port to one of the cylinders of the plurality of cylinders, and at least two discharge valve receiving bores, each discharge valve receiving bore having a discharge valve disposed therein, each discharge valve being a one-way valve oriented to facilitate gas flow from one of the cylinders of the plurality of cylinders to the discharge port rotating the crankshaft to reciprocate the pistons between a first position and a second position, and each of the discharge valves comprises a position at a lower level than at least one of the cylinders, the first position being remotely disposed from the modified head assembly relative to the second position, wherein when the pistons move from the second position to the first position, gas from the single suction port passes through the suction valves and into the plurality of cylinders, and wherein when the pistons move from the first position to the second position, gas from the plurality of cylinders passes through the discharge valves and exits the modified head assembly via the single discharge port.

8. The method of claim 7, wherein each rotation of the crankshaft causes one reciprocation of the pistons advancing towards the modified head assembly and retreating away from the modified head assembly.

9. The method of claim 7, further comprising: mounting a second modified head assembly to the engine block, the second modified head assembly being aligned with a second bank of cylinders of the plurality of cylinders.

10. The method of claim 9, further comprising: coupling the discharge port of the first modified head assembly to a suction port of the second modified head assembly.

11. The method of claim 7, wherein the modified head assembly mounted to the engine block is capable of handling on the order of 500 psi of natural gas disposed therein.

12. The method of claim 7, wherein the second surface of the modified head assembly is a bottom surface thereof.

13. The method of claim 7, wherein the pistons reciprocate in a horizontal plane and the discharge valves are disposed near a lower portion of the cylinders to facilitate drainage of moisture therefrom.

14. The gas compressor system of claim 7, wherein the flow of gas through the modified head assembly creates a venturi effect therein to facilitate moisture removal therefrom.

* * * * *